US005502844A

United States Patent [19]

Alvarado

[11] Patent Number: 5,502,844

[45] Date of Patent: Apr. 2, 1996

[54] SWIMMING GOGGLES

[76] Inventor: William Alvarado, 9 Baris La., Hopewell Junction, N.Y. 12538

[21] Appl. No.: 410,681

[22] Filed: Mar. 27, 1995

[51] Int. Cl.[6] ..... A61F 9/02

[52] U.S. Cl. ..... 2/445; 2/428; 2/452

[58] Field of Search ..... 2/428, 430, 445, 2/452; 351/156, 155, 43

[56] References Cited

U.S. PATENT DOCUMENTS 2,491,137 12/1949 Sameth ..... 2/452

3,791,721 2/1974 Helfrich ..... 351/156 X 5,406,340 4/1995 Hoff ..... 351/156

FOREIGN PATENT DOCUMENTS 0685459 12/1939 Germany ..... 2/452

*Primary Examiner*—Peter Nerbun

*Attorney, Agent, or Firm*—Joseph L. Spiegel

[57] ABSTRACT

In a pair of swimming goggles a first pull cord extends from one end of the head strap through the first eye piece and about its lens to apply pressure to the second eye piece, while a second pull cord extends from the other end of the head strap through the second eye piece and about its lens to apply pressure to the first eye piece.

2 Claims, 1 Drawing Sheet

SWIMMING GOGGLES

BACKGROUND OF THE INVENTION

1. Field of the Invention:

This invention relates generally to eye protective devices, and, in particular to goggles commonly used in swimming.

2. Description of the Prior Art:

Ihrcke, et al, U.S. Pat. No. 1,442,070 describes industrial goggles in which a pair of crystal or lens containing guards are joined together by an adjustable flexible bridge piece.

Pealersen, U.S. Pat. No. 1,886,725 describes an eye shield made of flexible material including the portion which extends over the bridge of the nose.

In Malcore, U.S. Pat. No. 1,890,690, the nose bridge piece between the eye cups of a pair of goggles is adjustably secured to each eye cup for adjustment to the contour of the wearer's face.

The patent to McLeod, U.S. Pat. No. 2,643,382 pertains to an eye shield in which flexible straps are threaded through transverse slots in the eye shield.

The Wade patent, U.S. Pat. No. 2,671,898 pertains to eye shields for protecting the eyes of the wearer. The shield is of Bakelite* material drilled with holes to receive a flexible holding cord. Adjustable pad elements are maintained in position by the cord on the underside of the shield in the region of the wearer's nose.

In Helfrich, U.S. Pat. No. 3,791,721 a single elastic means connects together a pair of cup members making up the goggles.

The sunglasses of Markovitz, et al, U.S. Pat. No. 5,302,977 have upper and lower frame members which contain an elastic cord that can be extended to fit around the wearer's ears.

In general, then it can be said that the attachment of straps or pull cords to the outer edge of each eye piece to keep the goggles in place is customary and well known in the art. A drawback is that you can never pull the straps tight enough to get adequate pressure to the nose bridge area on the inside edge of each eye piece. The result is that during diving and swimming the eye pieces of the goggles fill with water and will shift drastically during a dive.

Also while it is known to extend a strap or pull cord over the nose bridge area, prior art arrangements have not permitted tightening of same to increase pressure about the nose bridge area.

SUMMARY OF THE INVENTION

An object of the invention is improved swimming goggles.

Another object is such goggles that will fit more snugly on the wearer's face and not become detached during diving.

These and other objects features and advantages of the present invention are accomplished in accordance with the teachings of the present invention one embodiment of which comprises a pair of swimming goggles in which first pull cord extends from one end of the head strap through the first eye piece and about its lens to apply pressure to the second eye piece, while a second pull cord extends from the other end of the head strap through the second eye piece and about its lens to apply pressure to the first eye piece.

BRIEF DESCRIPTION OF THE DRAWING

Objects, features and advantages of the invention will be apparent from the following detailed description and accompanying drawing wherein.

DETAILED DESCRIPTION

Figure 1:
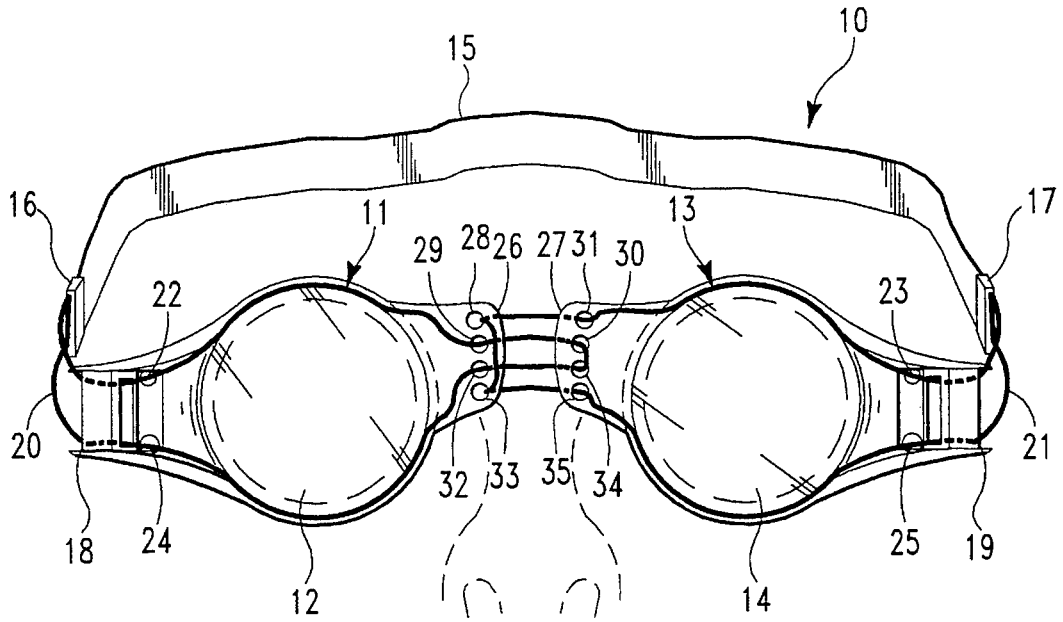
FIG. 1 is a perspective view of the goggles of the present invention.
Figure 2:
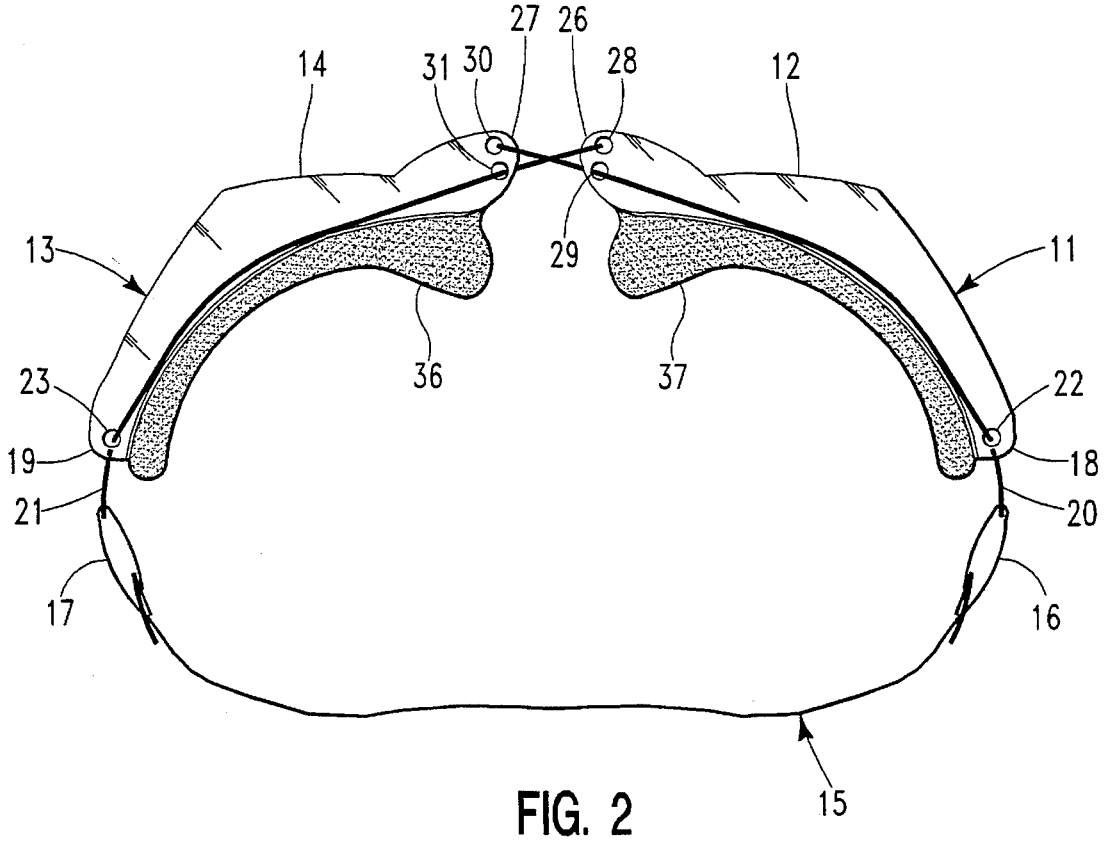
FIG. 2 is a top view of the goggles of the present invention.

Referring to FIGS. 1 and 2 of the drawing, goggles 10 constructed in accordance with the teachings of the present invention are shown.

The goggles 10 are seen as including a right eye piece 11 with lens 12 and a left eye piece 13 with lens 14. The goggles 10 include and elastic strap 15 which reaches around the head of the wearer in the usual manner. The strap 15 may be shortened at either end to tighten the goggles about the wearer's head by looping the ends through their respective tightening elements 16 and 17.

However, the ends of the straps are not fastened to or looped through the outer edges 18, 19 of the eye pieces 11, 13. Instead, the ends of the straps are looped about pull cords 20, 21 for the purpose to be described hereafter.

In accordance with one embodiment of the present invention the outer edges 18, 19 of the eye pieces 11, 13 are provided with upper 22, 23 and lower 24, 25 holes while the inner edges 26, 27 are provided with a pair of upper holes 28, 29, 30, 31 and lower holes 32, 33, 34, 35, respectively.

The pull cord 20 is seen as extending through outer edge upper hole 22, around the top of lens 12, through rear inner edge upper holes 29, diagonally across to front inner edge upper hole 30, down to rear inner edge lower hole 34, diagonally across to rear inner edge lower hole 32, around the bottom of lens 12 and finally through outer edge lower hole 24 to the place of beginning.

Pull cord 21 is seen as extending through outer edge upper hole 23, around the top of lens 14, through rear inner edge upper hole 31, diagonally across to front inner edge upper hole 28, down to front inner edge lower hole 33, diagonally across to rear inner edge lower hole 35, and around the bottom of lens 14, finally through outer edge lower hole 25 to the place of beginning.

Finally, the goggles 10 include padding 36, 37 which rests against the wearer's face below the eyes.

In the embodiment depicted the pull cord could terminate at the inner edge of the opposite eye piece instead of extending back to its place of beginning although a more positive snug fit seems to result where the cord passes through the holes in the opposite inner edge rather than terminating at same. The pull cords and strap can be of the same material.

It can be seen with this arrangement that the pull cords 20, 21 or strap 15 are not attached to the outer edges 18, 19 of the eye pieces 11, 12. Instead, the pull cords 20, 21 pass through openings in the nearer eye piece about its lens and into and through holes of the opposite piece. Thus when pull cord 20 is drawn tight the opposite eye piece 13 becomes snug because of its application of pressure to the opposite eye piece 13.

It should be obvious that changes, additions or omissions may be made in the details and arrangement of parts without departing from the spirit and scope of the invention as defined in the appended claims.

What is claimed is:

1. Goggles comprising:

a first eye piece;

a second eye piece;

strap means for tightening the goggles to a wearer's head;

a first means extending from the strap means across the first eye piece for applying a pulling force on the second eye piece towards the first eye piece; and, a second means extending from the strap means across the second eye piece for applying a pulling force on the first eye piece towards the second eye piece.

2. Goggles comprising:

a first eye piece having
a lens,
an inner edge and
an outer edge;

a second eye piece having
a lens,
an inner edge and
an outer edge;

a strap for tightening the goggles to a wearer's head, the strap including
a first end extending toward the outer edge of the first eye piece, and
a second end extending toward the outer edge of the second eye piece;

a first pull cord extending through the first eye piece and about its lens to the inner edge of the second eye piece for pulling the inner edge of the second eye piece towards the first eye piece inner edge; and, a second pull cord extending through the second eye piece and about its lens to the inner edge of the first eye piece for pulling the inner edge of the first eye piece towards the second eye piece inner edge, whereby tightening of the strap ends results in increased pressure at the nose bridge area of the goggles between the inner edges of the respective eye pieces.

* * * * *